US008947312B2

(12) United States Patent
Brown et al.

(10) Patent No.: US 8,947,312 B2
(45) Date of Patent: Feb. 3, 2015

(54) WIDE BAND ARRAY ANTENNA

(75) Inventors: Anthony Keith Brown, Manchester (GB); Yongwei Zhang, Manchester (GB)

(73) Assignee: The University of Manchester, Manchester (GB)

( * ) Notice: Subject to any disclaimer, the term of this patent is extended or adjusted under 35 U.S.C. 154(b) by 549 days.

(21) Appl. No.: 13/260,683

(22) PCT Filed: Mar. 31, 2010

(86) PCT No.: PCT/GB2010/000642

§ 371 (c)(1), (2), (4) Date: Nov. 21, 2011

(87) PCT Pub. No.: WO2010/112857

PCT Pub. Date: Oct. 7, 2010

(65) Prior Publication Data

US 2012/0146870 A1 Jun. 14, 2012

(30) Foreign Application Priority Data

Mar. 31, 2009 (GB) ..... 0905573.2

(51) Int. Cl.

| | |
|---|---|
| ***H01Q 21/08*** | (2006.01) |
| ***H01Q 9/04*** | (2006.01) |
| ***H01Q 19/00*** | (2006.01) |
| ***H01Q 21/06*** | (2006.01) |

(Continued)

(52) U.S. Cl.

CPC ..... *H01Q 19/005* (2013.01); *H01Q 21/061* (2013.01); *H01Q 21/26* (2013.01); *H01Q 21/29* (2013.01); *H01Q 1/36* (2013.01)

USPC ..... 343/824; 343/700 MS

(58) Field of Classification Search

CPC . H01Q 9/0407; H01Q 9/0442; H01Q 9/0464; H01Q 9/0478; H01Q 21/00; H01Q 21/06; H01Q 21/061; H01Q 21/062; H01Q 21/065; H01Q 21/067; H01Q 9/265; H01Q 9/065; H01Q 9/285; H01Q 3/24; H01Q 3/26; H01Q 3/2617; H01Q 3/2658

USPC ..... 343/725, 824

See application file for complete search history.

(56) References Cited

U.S. PATENT DOCUMENTS 4,684,954 A 8/1987 Sureau
4,929,959 A * 5/1990 Sorbello et al. ..... 343/700 MS (Continued)

FOREIGN PATENT DOCUMENTS

EP 0688040 12/1995

OTHER PUBLICATIONS

International Search Report and Written Opinion mailed Jun. 10, 2010 for corresponding International Patent Application No. PCT/GB2010/000642.

(Continued)

*Primary Examiner* — Hoang V Nguyen
*Assistant Examiner* — Patrick Holecek
(74) *Attorney, Agent, or Firm* — Swanson & Bratschun, L.L.C.

(57) ABSTRACT

An antenna array including a plurality of elements, the elements including at least one element of a first type and at least four elements of a second type wherein the element of the first type comprises part of two balanced feeds with two elements of the second type and the element of the first type is capacitively coupled to two further elements of the second type.

11 Claims, 21 Drawing Sheets

(51) Int. Cl.

| | |
|---|---|
| ***H01Q 21/26*** | (2006.01) |
| ***H01Q 21/29*** | (2006.01) |
| ***H01Q 1/36*** | (2006.01) |

(56) References Cited

U.S. PATENT DOCUMENTS

| | | | | |
|---|---|---|---|---|
| 5,293,176 | A | 3/1994 | Elliot | |
| 5,955,994 | A * | 9/1999 | Staker et al. | 343/700 MS |
| 6,057,802 | A * | 5/2000 | Nealy et al. | 343/700 MS |
| 6,300,906 | B1 | 10/2001 | Rawnick | |
| 6,552,687 | B1 | 4/2003 | Rawnick | |
| 6,697,019 | B1 * | 2/2004 | Hyuk-Joon et al. | 343/700 MS |
| 7,289,064 | B2 * | 10/2007 | Cheng | 343/700 MS |
| 7,315,288 | B2 * | 1/2008 | Livingston et al. | 343/770 |
| 7,450,071 | B1 * | 11/2008 | Volman | 343/700 MS |
| 2003/0132890 | A1 | 7/2003 | Rawnick | |

OTHER PUBLICATIONS

Search Report dated Jun. 17, 2009 for GB No. 0905573.2.

* cited by examiner

WIDE BAND ARRAY ANTENNA

RELATED APPLICATIONS

This application is a 35 U.S.C. §371 national phase application of CT/GB2010/000642 (WO 2010/112857), filed on Mar. 31, 2010, entitled "Wide Band Array Antenna", which application claims the benefit of GB Application Serial No. 0905573.2, filed Mar. 31, 2009, which is incorporated herein by reference in its entirety.

The present invention relates to antennas of the array type and in particular to such antennas which are designed to have a wide usable frequency bandwidth.

There are a large variety of existing microwave antenna designs, including those consisting of an array of flat conductive elements which are spaced apart from a ground plane.

Wide band dual-polarised phased arrays are increasingly desired for many applications. Such arrays which include elements that present a vertical conductor to the incoming fields, often suffer from high cross polarisation. Many system functions have well defined polarisation requirements. Generally, low cross polarisation is desired across the whole bandwidth.

Mutual coupling always occurs in array antennas and it is related to the element type, the element separation in terms of wavelength and the array geometry. It is normally a particular problem in wide bandwidth arrays where grating lobes production must be avoided. For the conventional Vivaldi notch antennas, the spacing of elements in the arrays must be less than the maximum element separation allowed for grating lobes free scan. This is due to input impedance anomalies caused by the strong coupling induced between the elements for large scan angles. Potentially more elements are required to cover the same collecting area. As a result, the design seeks to minimise the coupling although this is problematic.

'Munk' antennas as disclosed in B. Munk, "A wide band, low profile array of end loaded dipoles with dielectric slab compensation," *Antennas Applications Symp.*, pp. 149-165, 2006, use a fundamentally different approach to design the wideband array. An example is shown in FIG. 1. Mutual coupling is intentionally utilised between the array elements, and controlled by introduction of capacitance. An element consists of a part of coupled dipoles (14,20) and (12,16). The capacitance (18,22) between the ends of dipoles smoothes the radiated fields and achieves a broad bandwidth. The impedance stability over the frequency band and scan angles required is enhanced by placing dielectric layers on top of the dipole array.

The superimposed dielectric layers are important to the design of the Munk dipole array. Three or four layers of dielectric slabs are required in order to achieve a broad bandwidth. Cost becomes high for a large scale array.

One antenna type using the principles expounded by Munk is the Current Sheet Array (CSA). A CSA formed by using closely spaced dipole elements is shown in FIG. 1. The configuration here consists of two layers of dielectric material (2,6) on top of the dipole array (one part shown in FIG. 1) in addition to two thin sheets (both shown as layer 8) on both sides to embed the dipole elements (12,14,16,18,20,22) therebetween. FIG. 2 shows a Munk Array incorporating an aspect of the present invention, which is that the layers of dielectric slabs on the top are replaced by array of metal patches with predetermined shapes and a relative distance from the array elements as shown in FIG. 2. The scan performance for the dipole array of FIG. 1 is shown in FIG. 3*a*, and that for the array of FIG. 2 is show in FIG. 3*b*.

The present invention aims to provide a new array antenna structure which has improved performance over the prior art.

Accordingly, in a first aspect, the present invention provides an antenna array including a plurality of elements, the elements including at least one element of a first type and at least four elements of a second type wherein the element of the first type comprises part of two balanced feeds with two elements of the second type and the element of the first type is capacitively coupled to two further elements of the second type.

Unlike the prior art, the present invention utilises elements of two distinct types. In some embodiments of the present invention, elements of both types have the same physical structure (as will be seen in the figures) but in the present invention the elements are arranged such that they perform the functions of one or the other of the types set out above.

Preferably the array includes further elements. For example, the array may include further elements of the first type and arranged such that each element of the second type is both capacitively coupled to an element of the first type and also forms part of a balanced feed with an element of the first type.

Preferably, each element of the second type is only capacitively coupled to one element of the first type and also forms part of only one balanced feed with an element of the first type.

Preferably the two balanced feeds are positioned perpendicularly to each other, and each feed will produce an independently linearly polarised signal. This is termed a dual-polarised antenna.

Of course in practice such antenna arrays are not infinite in size and at the edges of any array there will be additional elements, for example of a third type. Again, such elements may be identical in physical structure to the elements of the first two types, but by virtue of being at the edges of the array cannot be connected in the same ways.

Generally in an antenna array according to the present invention the four elements of the second type will preferably be spaced equally around the element of the first type with which they are associated.

In some embodiments of the present invention, the capacitive coupling is provided by the inclusion of discrete capacitors. However, in alternative embodiments, the capacitive effect is achieved by interdigitating areas of the respective elements which are being coupled. Preferably the size of the areas being interdigitated and the amount of interdigitation is chosen to provide the desired level of capacitive coupling.

In a further aspect, the present invention provides a method of creating an antenna array including the step of providing elements of the first and second types as previously described and arranging them as also previously described.

Preferably, the elements are non-dipole in shape. More preferably, the elements are circular or polygonal in shape. In some examples, the elements may have an area of non-conductive material in their centres, for example they may be shaped as rings. In preferred embodiments, the elements are shaped as polygonal or octagonal rings.

Generally, the elements according to the present invention are arranged in a planar array. In addition, the array may include a further ground plane which is separated from the element array by a layer of dielectric material. The ground plane may itself take the form of an array of elements similar in structure to the planar element array. The dielectric material may preferably be expanded polystyrene foam.

Embodiments of the present invention will now be described with reference to the accompanying drawings in which.

Figure 1:
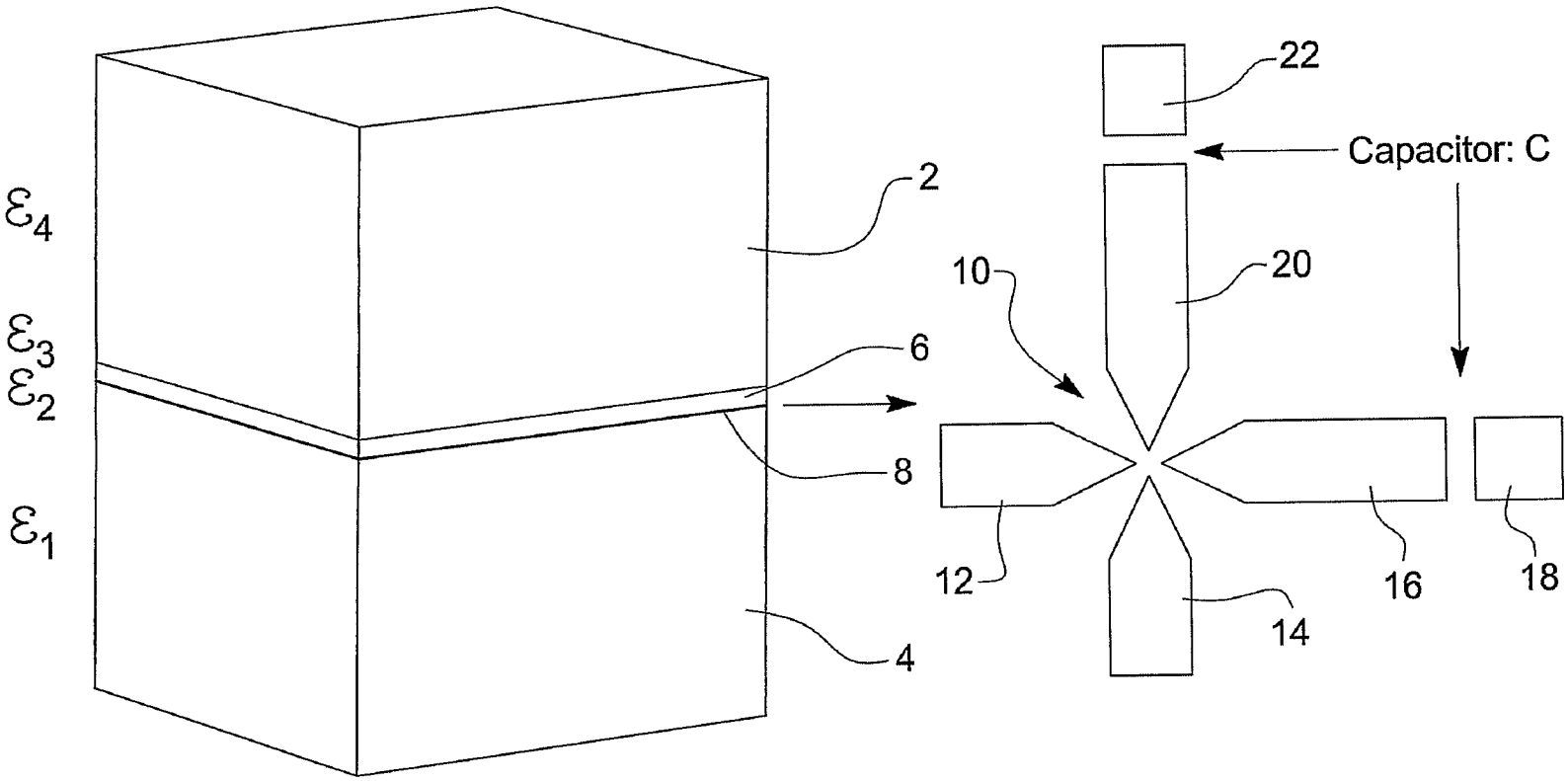
FIG. 1 shows an example of a prior art "Munk" dipole antenna.
Figure 2:
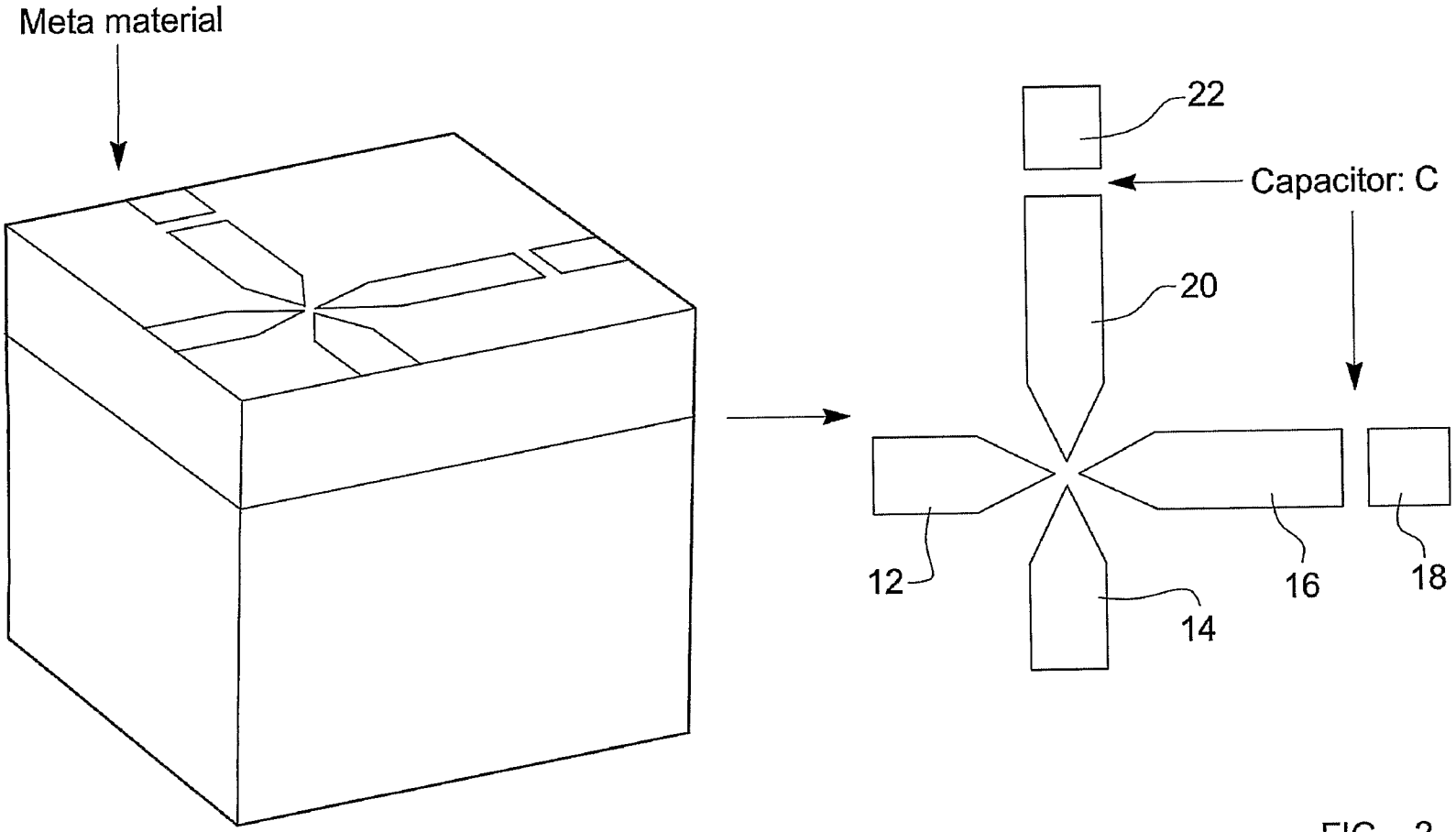
FIG. 2 shows an example of a "Munk" dipole antenna including modifications according to the present invention.
Figure 3A:
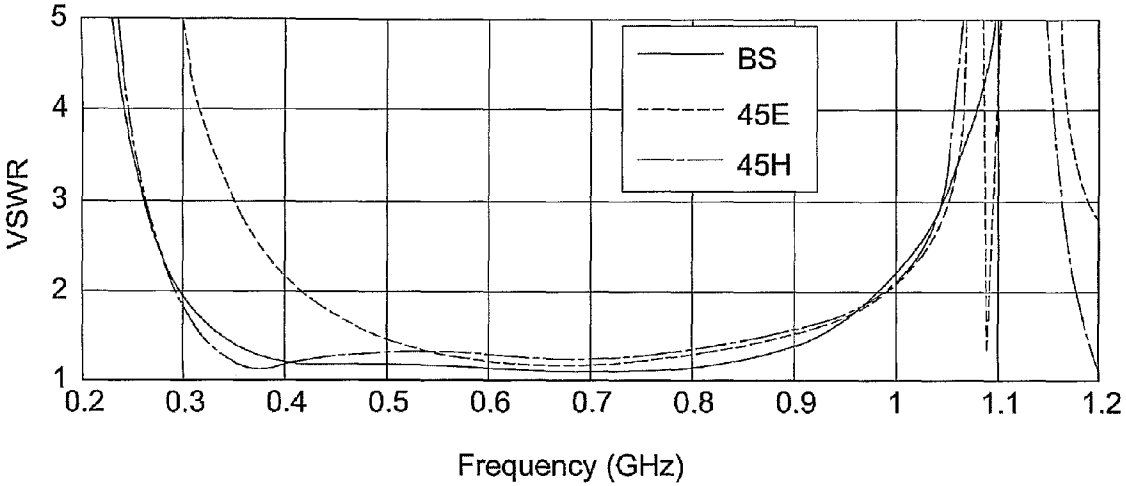
Figure 3B:
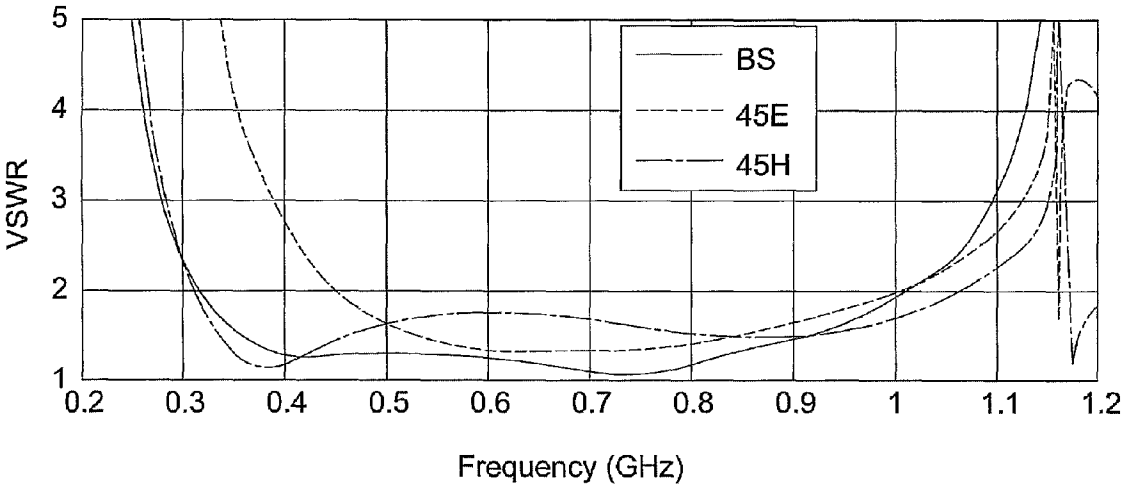

FIGS. 3*a* and 3*b* show the performances responses of the antennas of FIGS. 1 and 2.

Figure 4:
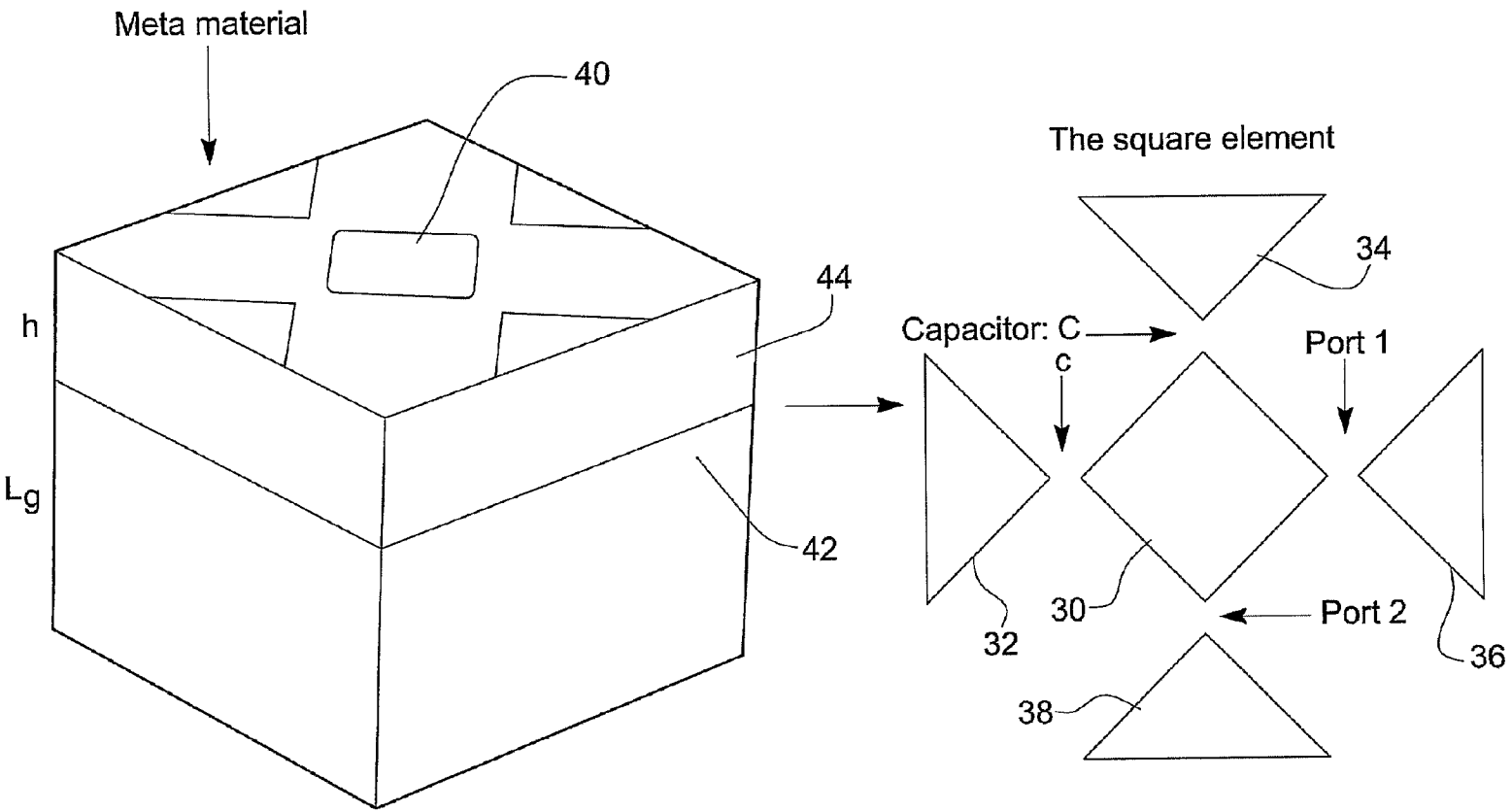
Figure 5:
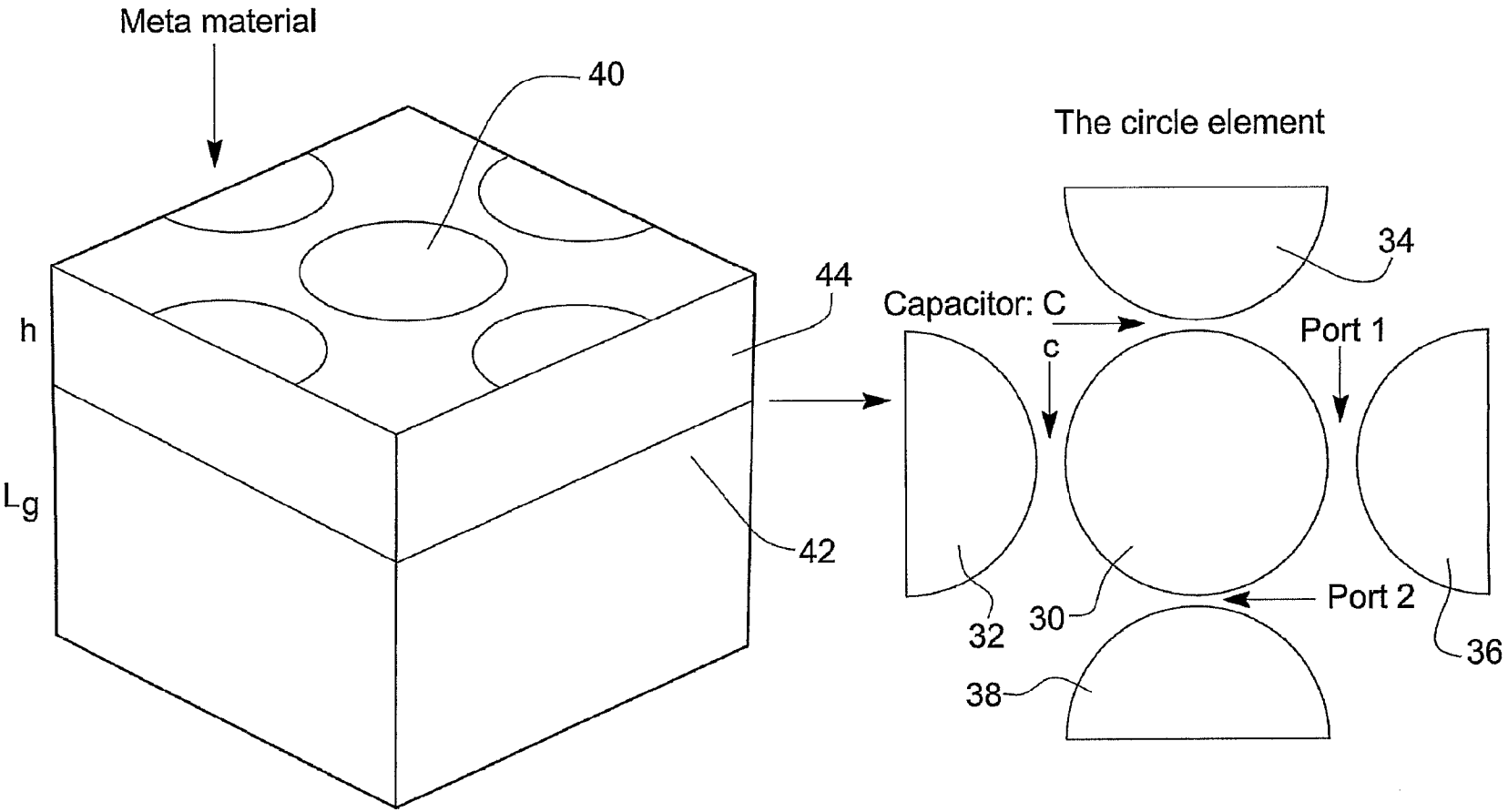
Figure 6:
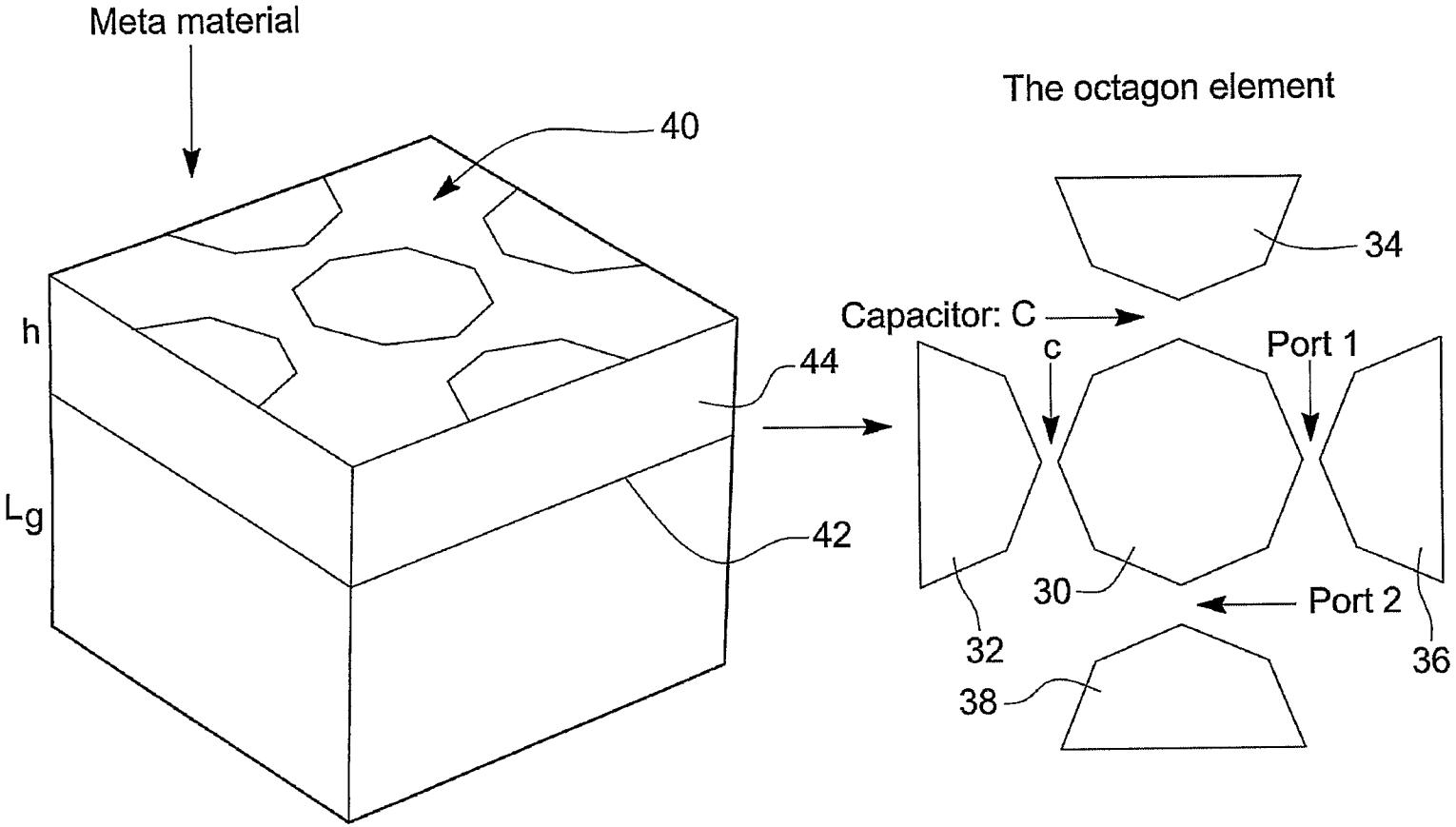

FIGS. 4, 5 and 6 show embodiments of the present invention utilising, respectively, square, circular and octagonal shaped elements.

Figure 7A:
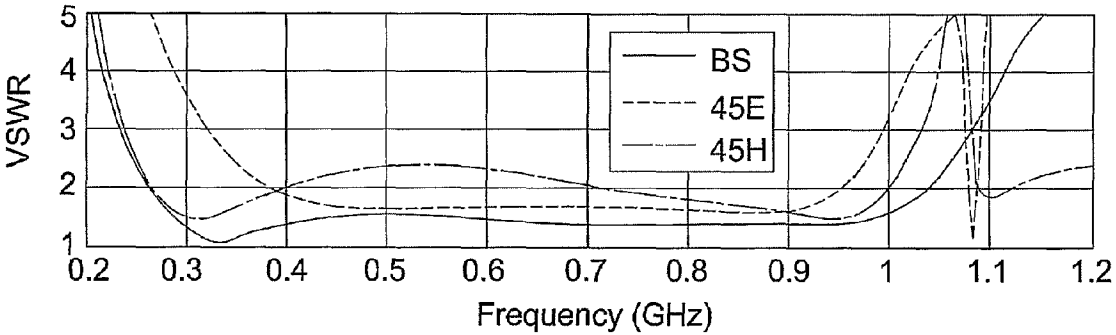
Figure 7B:
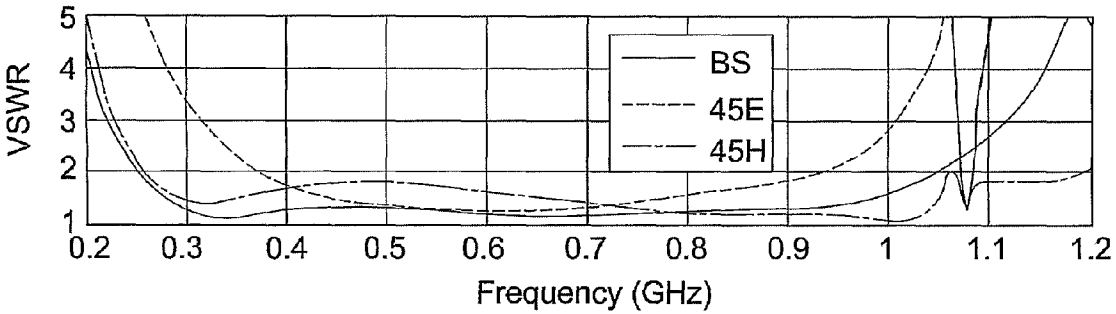
Figure 7C:
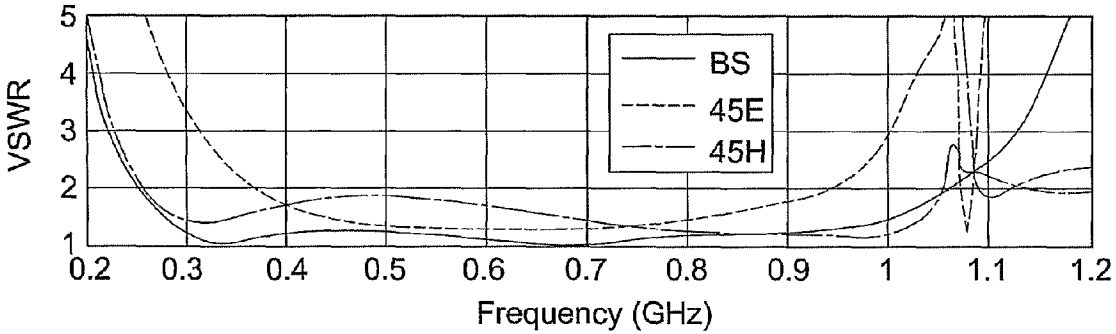

FIGS. 7*a*, 7*b* and 7*c* show the frequency response of the designs of FIGS. 4, 5 and 6 respectively.

Figure 8:
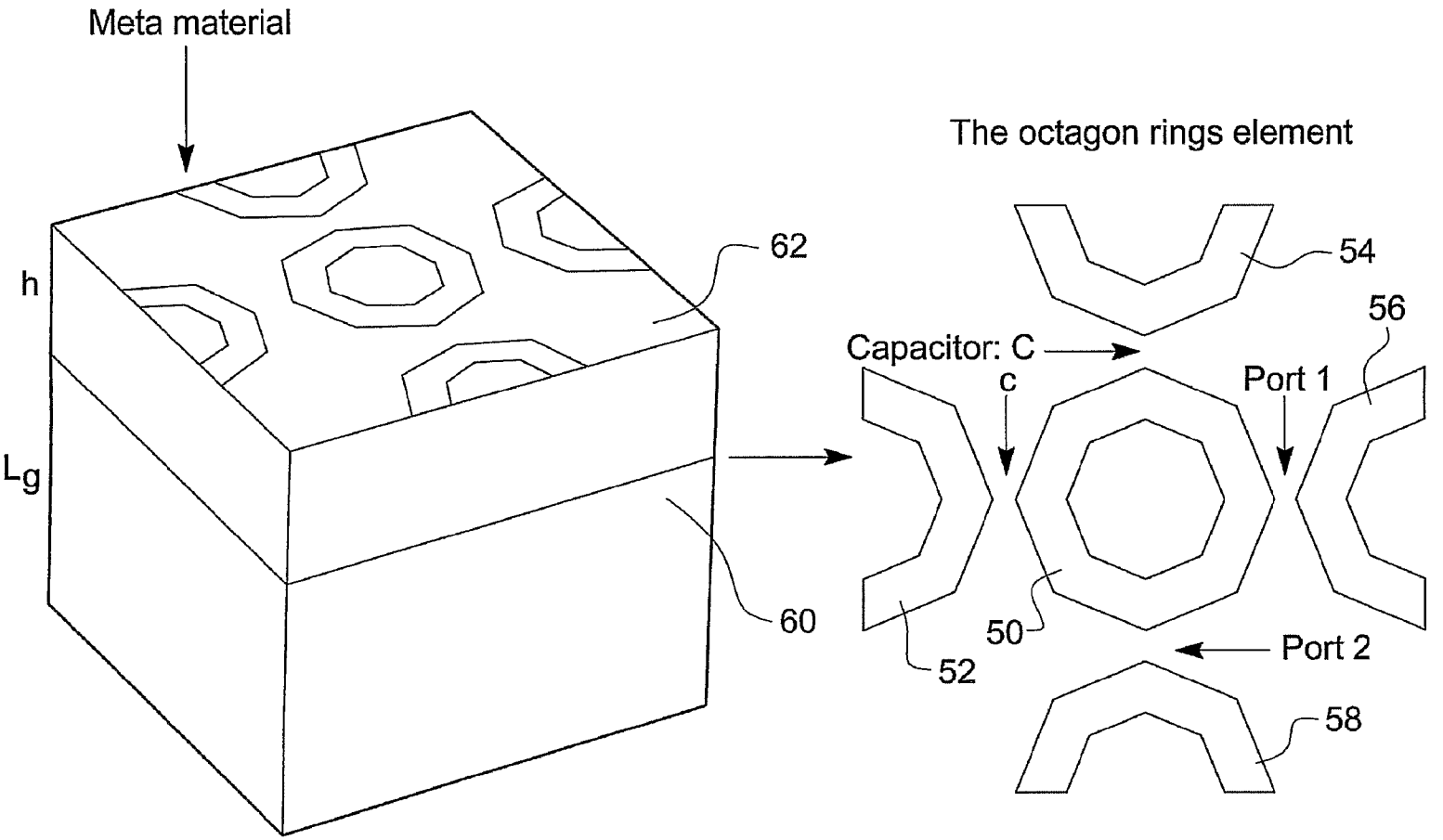

FIG. 8 shows a further embodiment of the present invention utilising "ring" elements which are octagonal.

Figure 9:
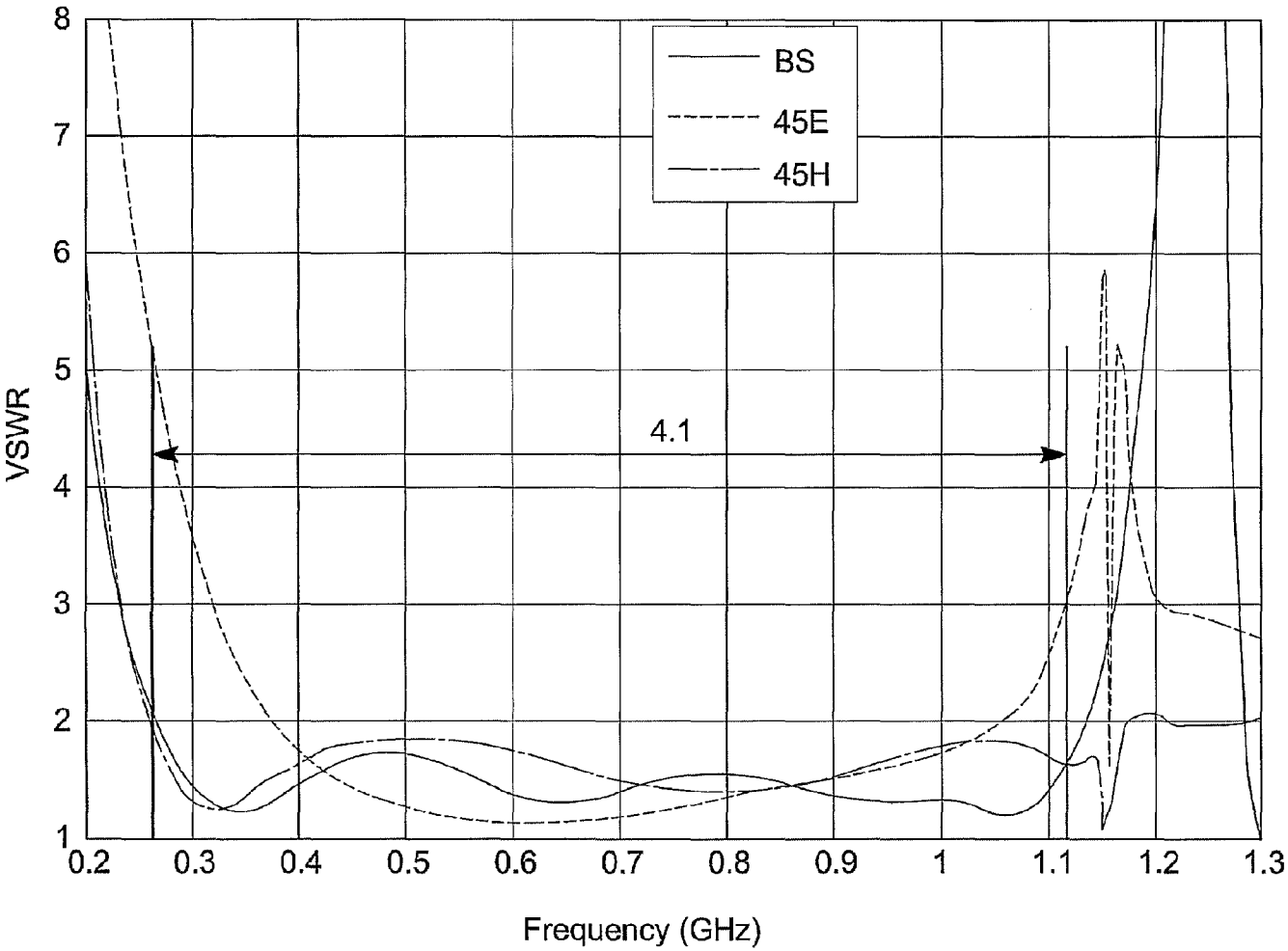

FIG. 9 shows the frequency response of the embodiment of FIG. 8.

Figure 10:
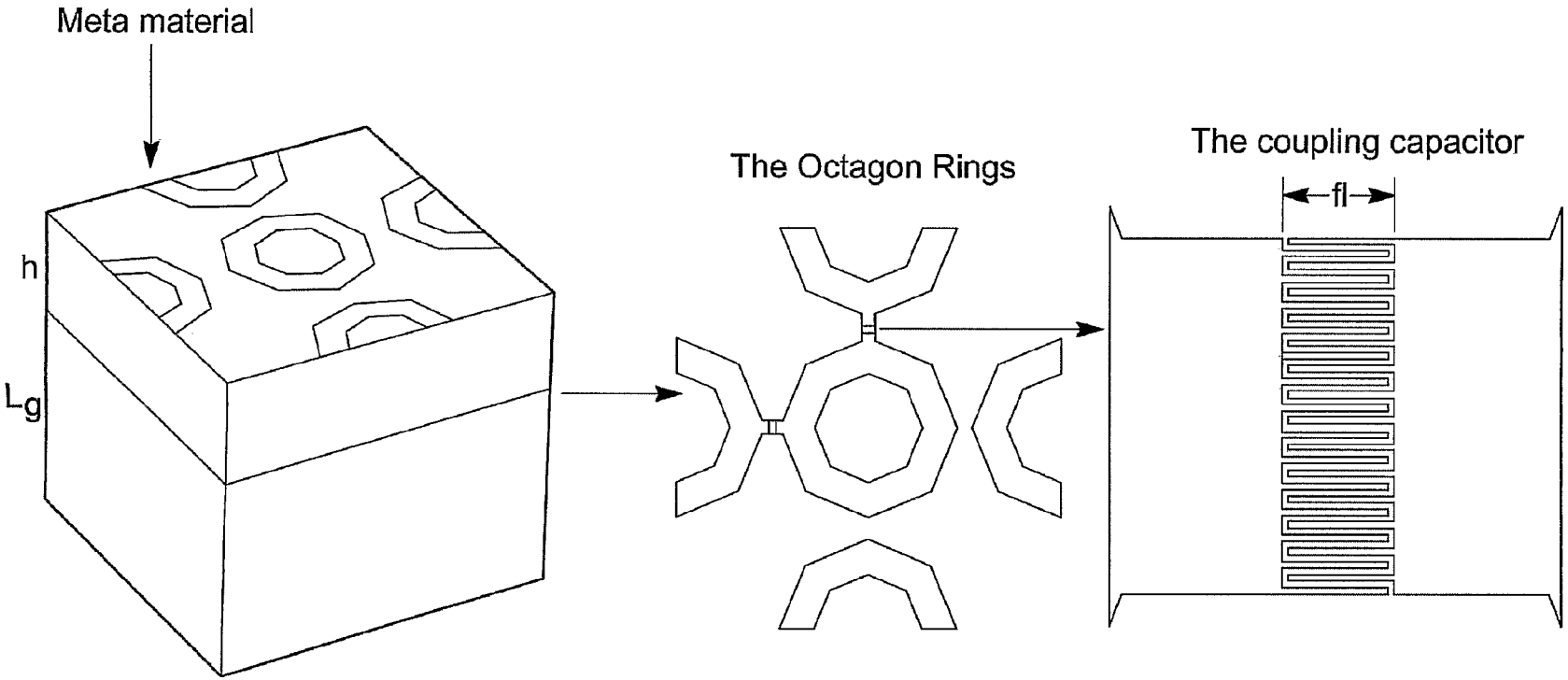

FIG. 10 illustrates the use of inter-digitated coupling capacitors in the design of FIG. 8.

Figure 11A:
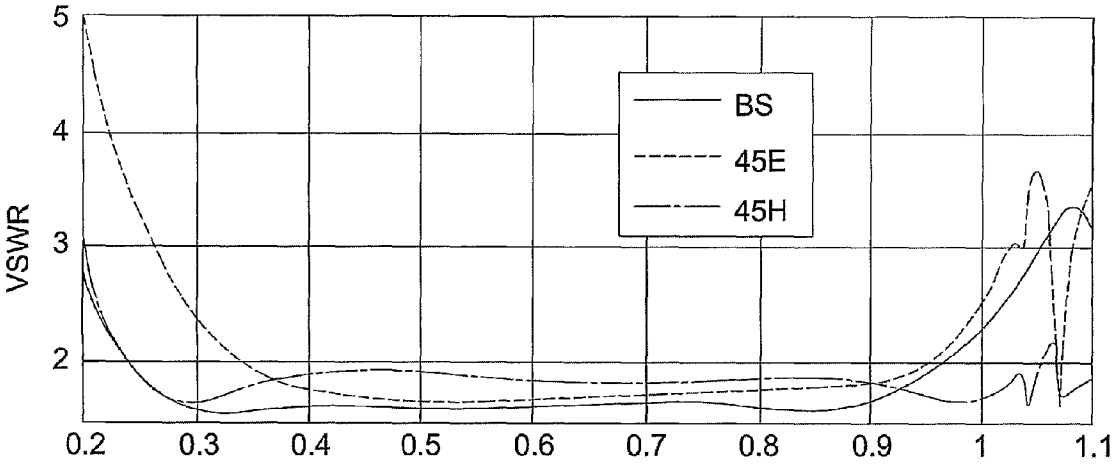

FIG. 11*a* shows frequency response of the design of FIG. 8 using a one pF.

Figure 11B:
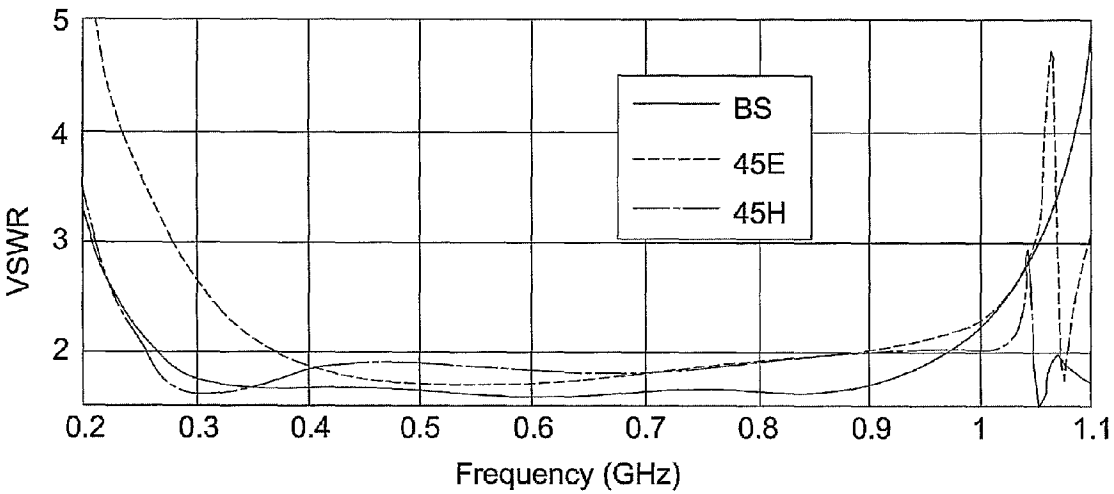

FIG. 11*b* shows the frequency response of the design of FIG. 8 using the digitated coupling capacitors.

Figure 12:
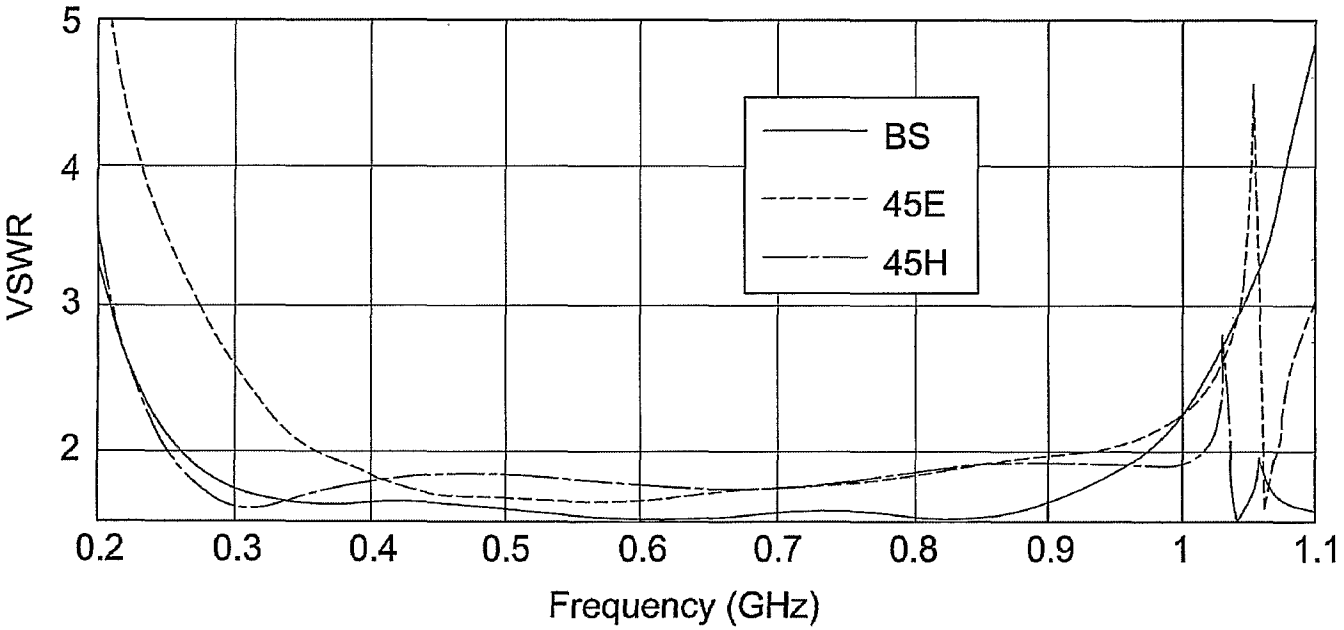

FIG. 12 shows further frequency responses of the design of FIG. 8 using interdigitated coupling capacitors.

Figure 13:
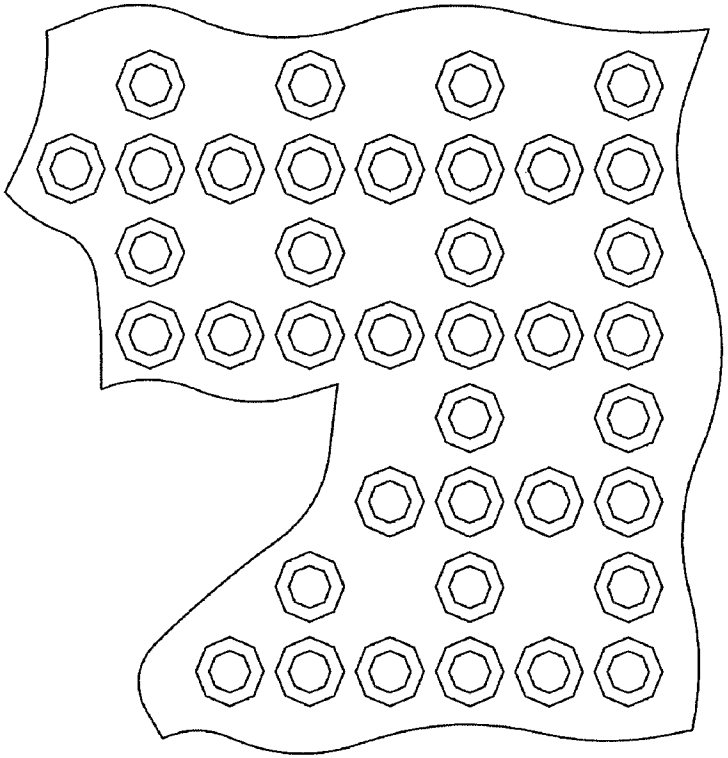

FIG. 13 illustrates a small 3×4 array using the design of FIG. 8.

Figure 14:
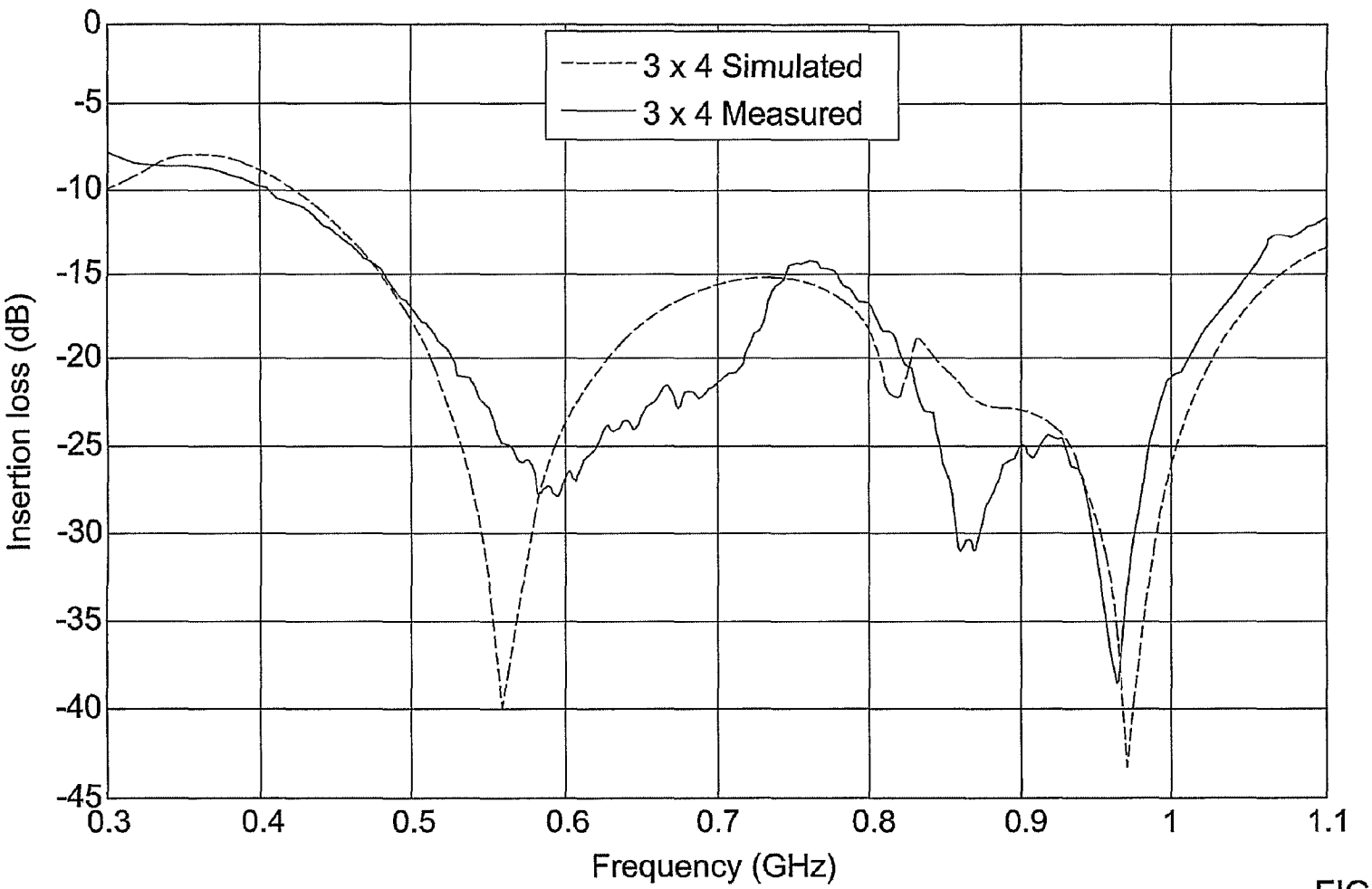

FIG. 14 shows the insertion loss of the design FIG. 13.

Figure 15:
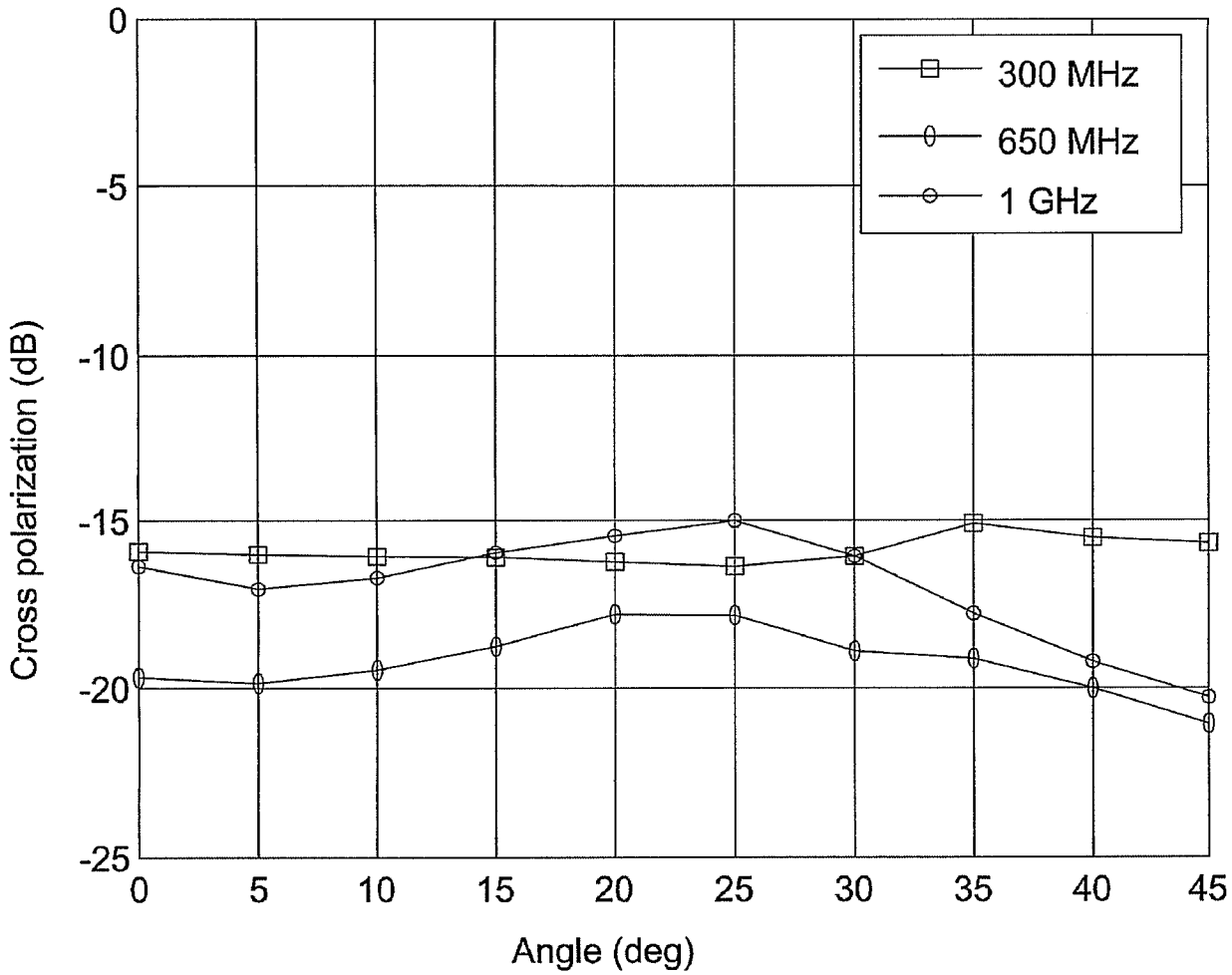

FIG. 15 shows the cross-polarisation performance for an element in an infinite array based on FIG. 8.

Figure 16A:
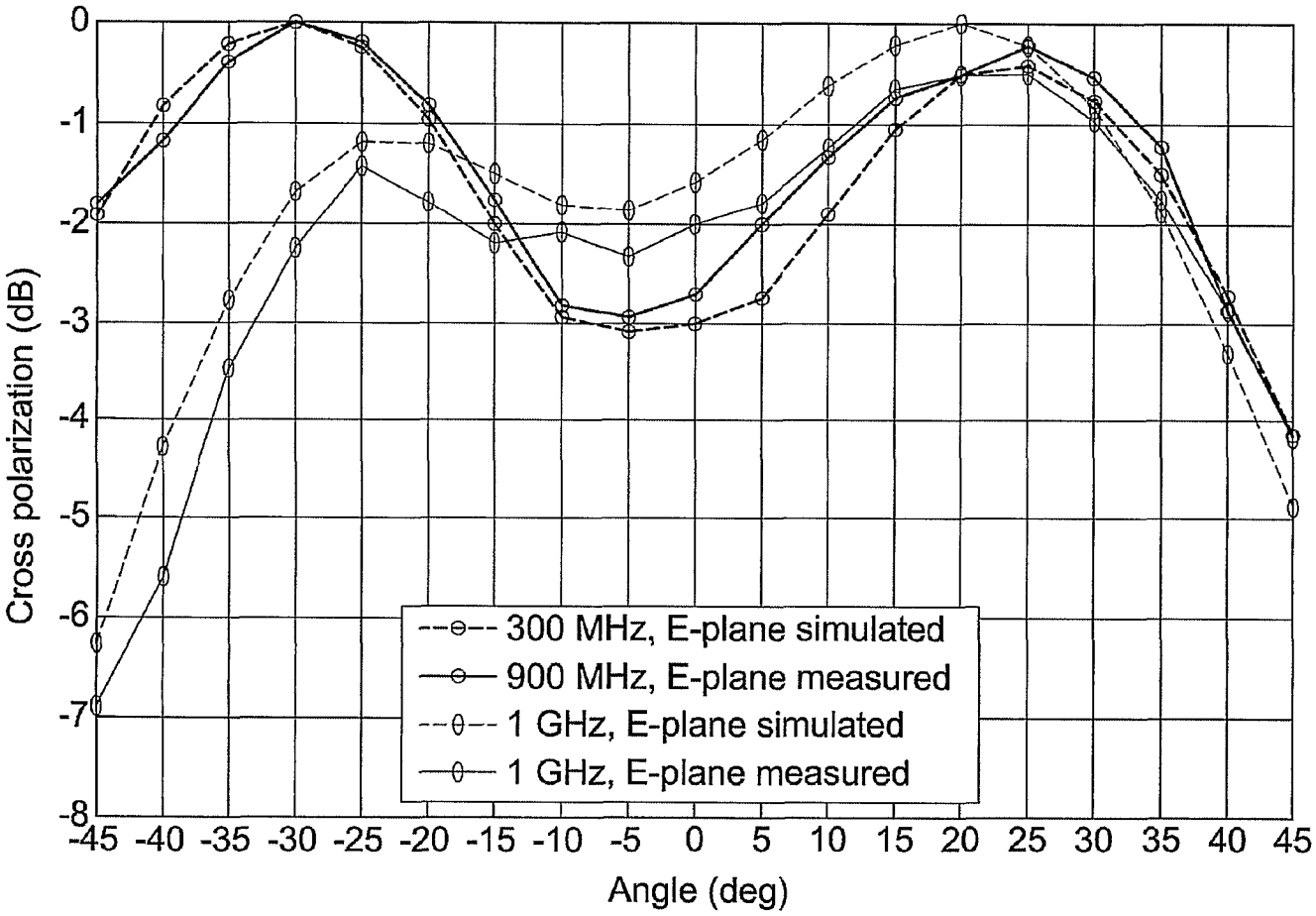
Figure 16B:
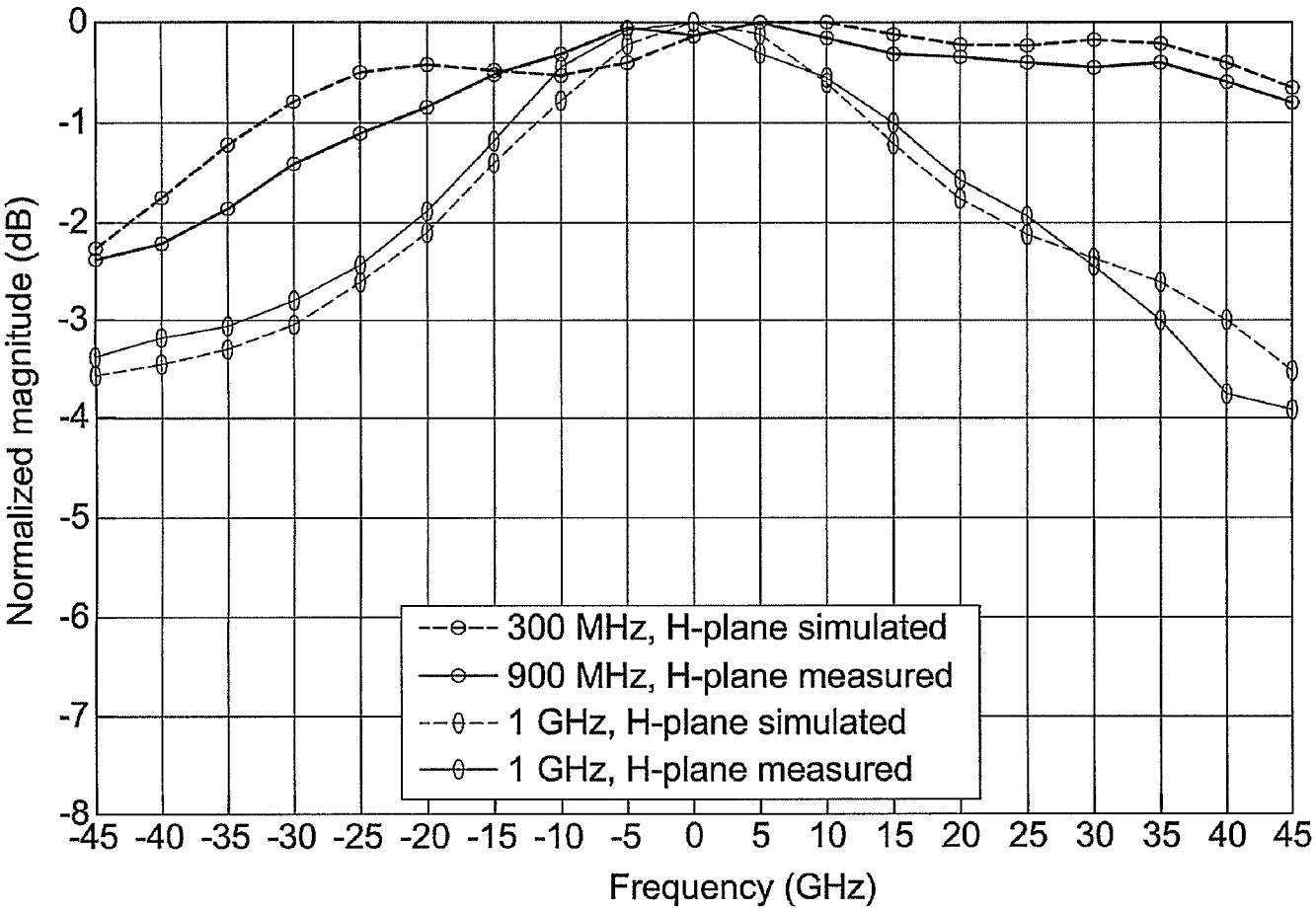

FIG. 16*a*, 16*b* show the radiation patterns for the centre element of the 3×4 array of FIG. 13 based on measurement.

Figure 16C:
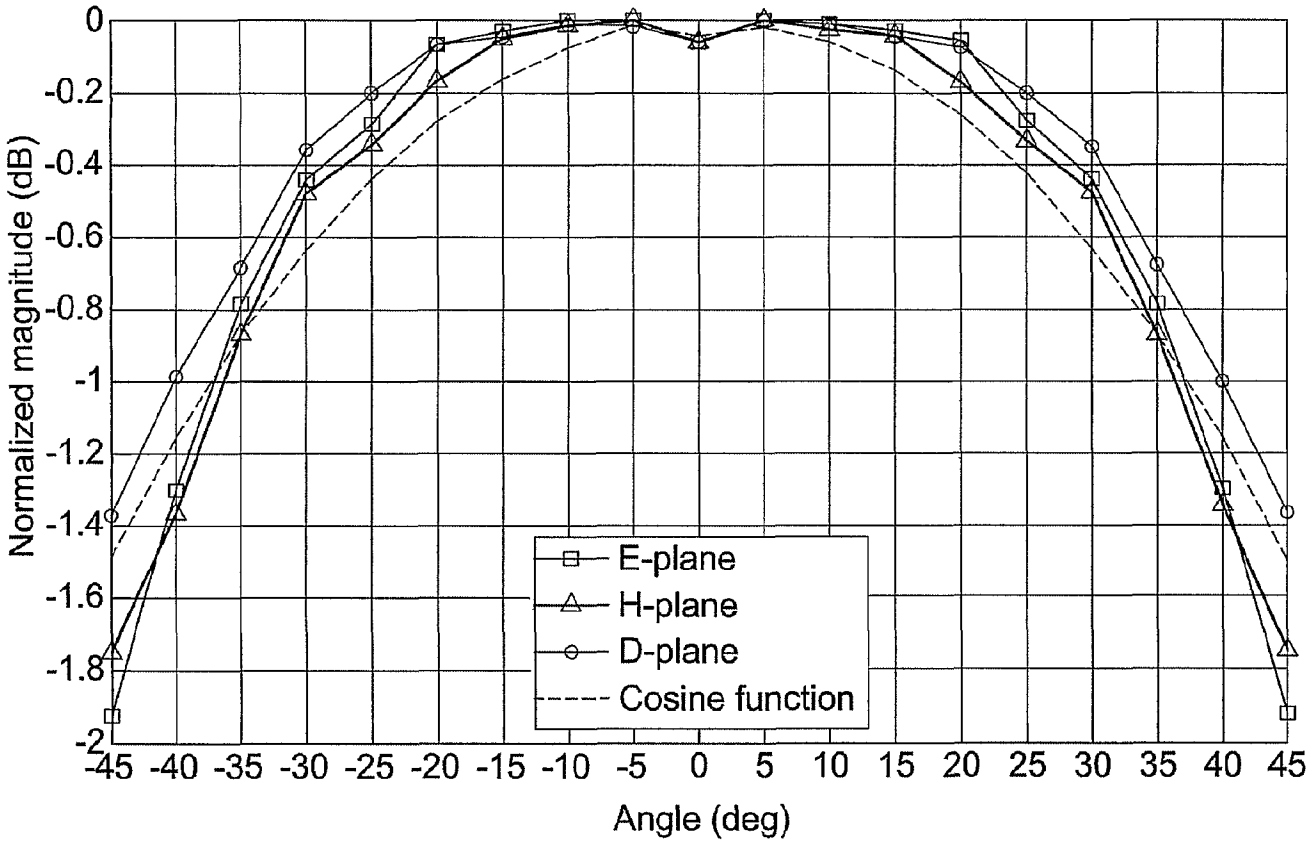

FIG. 16*c* shows the radiation pattern for an element in an infinite array based on FIG. 8.

Figure 17:
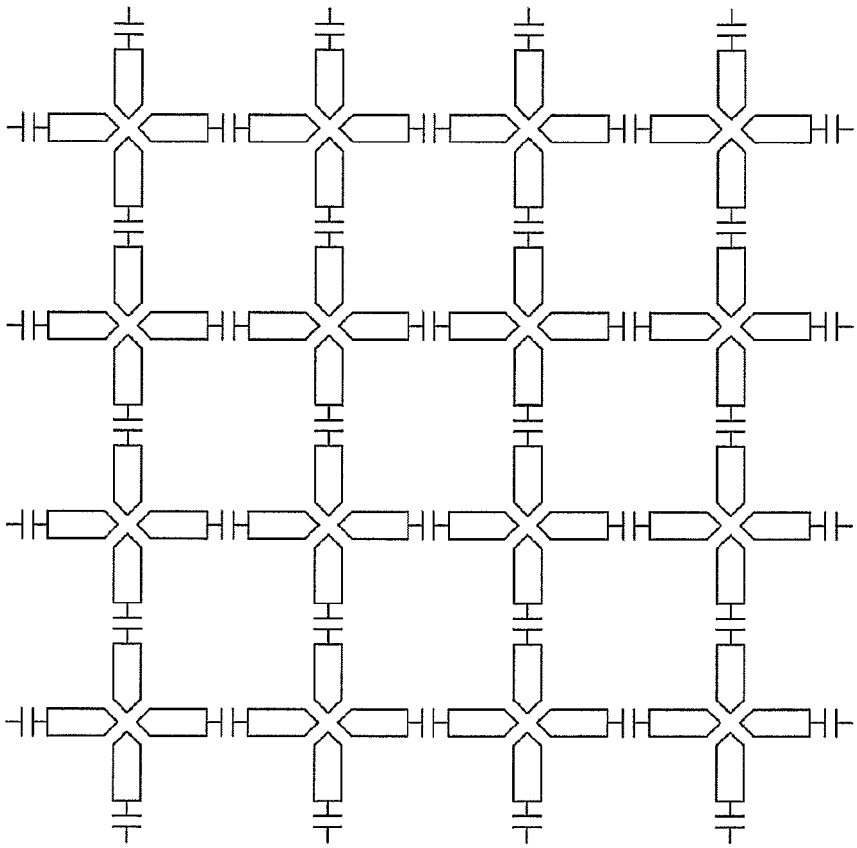

FIG. 17 illustrates a larger array made up with elements in accordance with the prior art designs of FIG. 1 or FIG. 2.

Figure 18:
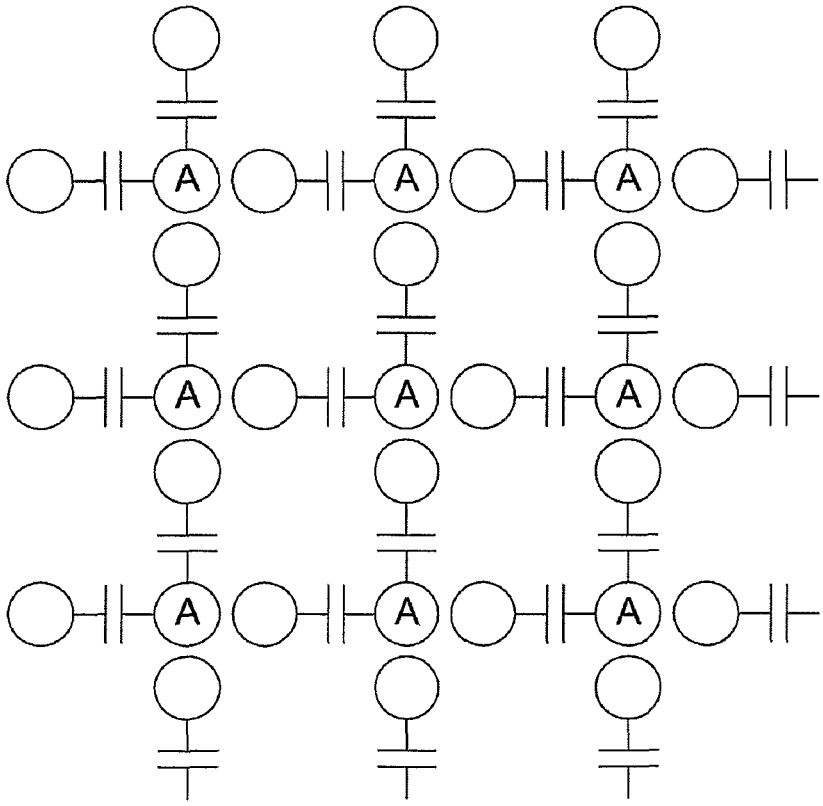

FIG. 18 illustrates a large array made up with general elements according to the present invention.

Figure 19:
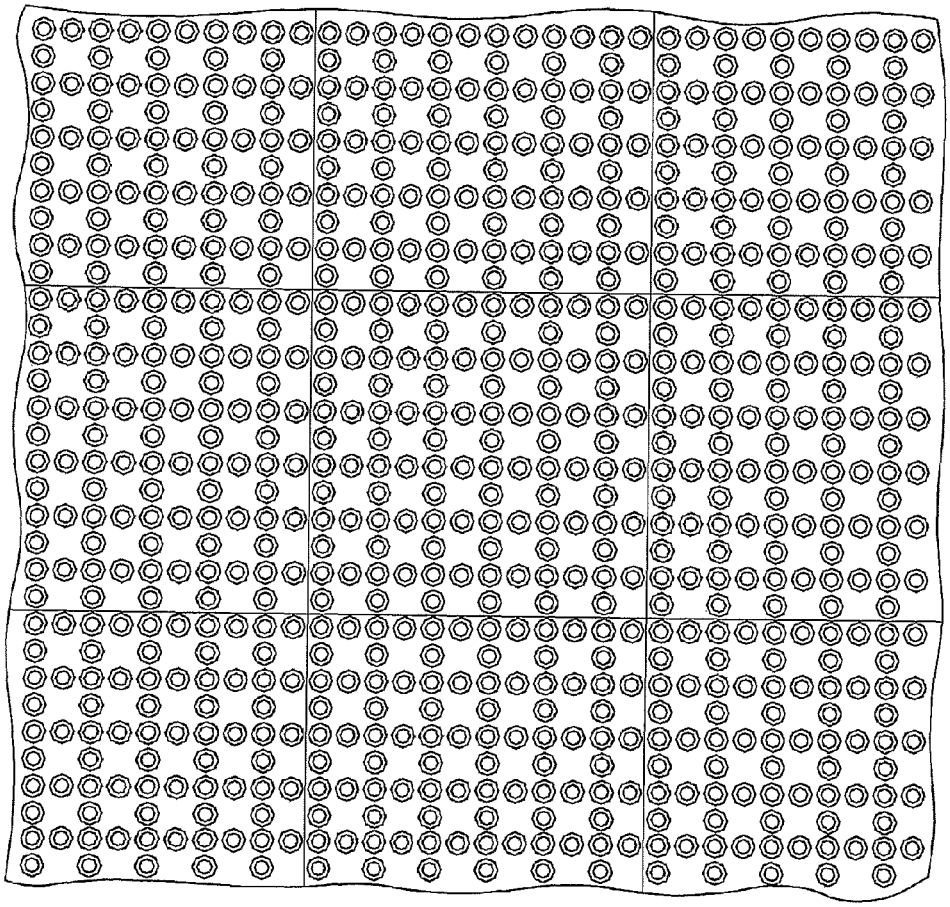

FIG. 19 shows an embodiment of a larger array utilising the design of FIG. 8.

FIG. 4 shows an embodiment of the present invention utilising square-shaped elements. In FIG. 4 can be seen a central element 30 surrounded by (preferably equispaced) elements 32, 34, 36 and 38. The central element 30 is coupled to elements 32 and 34 (only half of each of which is shown) by respective capacitors C. In addition, element 30 forms half of two balanced fed element pairs, one pair is with element 36 and the other pair with element 38. Again, only half of elements 36 and 38 are shown in FIG. 4. The two element pairs provide ports 1 and 2 for use in the array.

In practice, the arrangement shown in FIG. 4 (and FIGS. 5, 6 and 8) will form part of a larger array, where the pattern is repeated. This is described more fully later on with reference to FIGS. 17, 18 and 19.

One further preferred feature of some embodiments of the present invention is the incorporation of an additional conductive layer parallel to and spaced from, the main antenna element array layer. The main antenna array layer is shown as 42 in FIG. 4, and a further layer of similar (but in this case scaled-down) conductive elements is labelled 40. This is spaced from layer 42 by use of a dielectric 44.

FIG. 5 shows a further embodiment of the present invention, which is similar to that of FIG. 4 but uses circular-shaped elements instead. The same reference numerals have been reused.

FIGS. 7*a* and 7*b* show the frequency responses for the designs of FIGS. 4 and 5 respectively. The scan performance in the H-plane has been found to be better for the circular design of FIG. 5 and the square design of FIG. 4.

FIG. 6 shows a further embodiment of the present invention, which is similar to those of FIGS. 4 and 5 but in this case uses octagonal-shaped elements. Again, the same reference numerals are used. FIG. 7*c* shows the SWR for the dual-polarised thin octagon patch antenna array of FIG. 6.

It is believed that in the antenna design of FIG. 6 (and FIGS. 4 and 5) the current flow is primarily along the edge of each element. Therefore a further embodiment of the present invention shown in FIG. 8, which utilises the octagonally-shaped elements of FIG. 6 but in the design of FIG. 8 these elements are hollow or ring-shaped. This is believed to reduce the coupling between the orthogonal ports in a unit cell. This particular design is referred to in the specification as an "octagon rings antenna" (ORA). This is believed to reduce the coupling between the orthogonal ports in a unit cell. This particular design is referred to in the specification as an "octagon rings antenna (ORA)", but generally discussion of the other features of this design which follows are equally applicable to the other designs previously described.

In FIG. 8, a central element 50 is surrounded by four (preferably equispaced) elements 52, 54, 56, 58. As before, central element 50 is coupled to elements 52 and 54 via respective capacitors C. Also central element 50 forms part (in this case half) of two element pairs with respective elements 56 and 58. Again, these elements maybe encapsulated between two layers of dielectric in a thin layer 60. Preferably the antenna design also includes a further conductive layer 63 spaced apart from the main antenna layer 60.

The scan performance for an optimised ORA with the unit cell size of 150 mm is show in FIG. 9. The ratio between the size of the reflection ring and the element ring is 0.94 and the coupling capacitance value is 1 pF.

Bulk capacitors may be soldered between the octagonal ring (or other shaped) elements. Alternatively, and preferably, capacitance is provided by interdigitating the spaced apart end portions to control the capacitive coupling between the adjacent ORA elements. The interlaced fingers can replace the bulk capacitors between the elements to provide increased capacitive coupling. For the dual-polarised ORA array with 165 mm pitch size, capacitors of 1 pF are used, for example, each capacitor can be built with 12 fingers with the length of the finger of 2.4 mm. The gap between the fingers is e.g. 0.15 mm. This is shown in FIG. 10. The scan performance comparison between the array using 1 pF bulk capacitor or the interdigitated capacitor with 12 fingers is shown in FIG. 11. The unit cell configuration is based on h=70 mm, $L_g$=110 mm, sf=0.9. The same unit cell with interdigitated capacitors configuration is shown from simulation. The active VSWR performance with scan is shown in FIG. 12.

A 3×4 finite ORA is built and shown in FIG. 13. The comparison of the insertion loss of the centre element between the simulation and the measurement is shown in FIG. 14. The measurement has been conducted by feeding the centre element with a CPW-CPS impedance transformation balun and the rest elements terminated with matched loads of 120 ohms. The element spacing is 165 mm and the capacitance value for the bulk capacitors between the elements is 1 pF. However, there is a discrepancy between the centre element in a finite array and the centre element in an infinite array simulation. This indicates that the 3×4 elements array performance may be improved by increasing the size of the array, e.g. as shown in FIG. 19.

The cross polarisation in the Diagonal-plane scan at three typical frequencies for the ORA infinite array is shown in FIG. 15. It shows a low and smooth cross polarisation performance over the entire scan range. It is noted that the array exhibits the best cross polarisation at the centre of the frequency band. This property has a similarity to a dipole array.

The active element pattern can be used to predict the performance of large phased array antennas and prevent array design failure before the large array system is fabricated. The active element pattern for an infinite ORA array is shown in FIG. 16*c*. It is noted that the element pattern is reasonably symmetric in all planes and close to an ideal cosine pattern in the scan volume.

In general, the embodiments of the present invention intend to provide one or more of the following advantages.

In order to illustrate larger arrays, FIGS. 17 and 18 show examples of such larger repeating arrays. FIG. 17 shows a larger array using the type of prior art element shown in FIG. 1 or 2. As can be readily seen, each individual element of this array is identical to all of the other elements in the array (except of course for the ones at the edges of the array). Generally, each element forms part of a radiating element pair with another such element and also is capactively coupled to one such element.

FIG. 18 shows a larger array utilising elements according to the present invention, for example as shown in any of FIGS. 4, 5, 6 and 8. As can be readily seen, excluding the elements at the edges of the array, the elements not at the edges whilst physically identical can actually be categorised as being of two distinct types. There can be considered to be centre elements (labelled "A") which, as previously described, form part of two dipoles with two other elements and in addition are capactively coupled to two further elements. The other type of element in the array forms part of only one element pair and is capacitively coupled to only one other element.

Embodiments of the present invention may be useful in any or all of the following applications.

Advantages

- The operational bandwidth can be 4:1 or more and the maximum scan angle can be 45° or more.
- Electronically Steerable antenna.
- A stable cross polarisation performance in the whole scan volume.
- Compact configurations with dual polarisations.
- multiple dielectric layers need not be used which reduce cost and complexity.
- Horizontal planar structure is easy to be implemented in mass manufacture.
- The loss of gain with scan angles is less than the many previous element types.

Applications

- Radio astronomy
- Radar (Ground probing)
- Ultra-wide band communications
- Airborne wideband imaging
- Applications where a compact wideband array is desired.
- The application where dual polarisation and wide field of view are desirable The present invention has been described with reference to preferred embodiments. Modifications of these embodiments, further embodiments and modifications thereof will be apparent to the skilled person and as such are within the scope of the invention.

The invention claimed is:

1. An antenna array including a plurality of elements, the elements including elements of a first type and at least four elements of a second type wherein

- at least some of the elements of the first type comprise part of two balanced feeds with two elements of the second type and
- at least some of the elements of the first type are capacitively coupled to two further elements of the second type;
- wherein each element of the second type is only capacitively coupled to one element of the first type and also forms part of only one balanced feed with an element of the first type.

2. An antenna array according to claim 1 wherein the elements are not linear in shape.

3. An antenna array according to claim 2 wherein the elements are circular or polygonal in shape.

4. An antenna array according to claim 3 wherein the elements have an area of non-conductive material in their centres.

5. An antenna array according to claim 4 wherein the elements are ring-shaped.

6. An antenna array according to claim 5 wherein each element is shaped as an octagonal ring.

7. An antenna array according to claim 1 wherein the elements are arranged in a planar array.

8. An antenna array according to claim 7 further including a ground plane separated from the planar element array by a layer of dielectric material.

9. An antenna array according to claim 8 wherein the dielectric material layer is expanded polystyrene foam.

10. An antenna array according to claim 1 wherein for each element of the first type the four elements of the second type associated with it are spaced equally around it.

11. An antenna array according to claim 1 in which the capacitive coupling between elements is achieved by areas of those elements being interdigitated.

* * * * *